United States Patent [19]

Schauer

[11] 4,216,175

[45] Aug. 5, 1980

[54] CARBURETOR FOR COMBUSTION ENGINES

[75] Inventor: Walter Schauer, Neuss, Fed. Rep. of Germany

[73] Assignee: Firma Pierburg GmbH & Co. KG, Neuss, Fed. Rep. of Germany

[21] Appl. No.: 8,396

[22] Filed: Feb. 1, 1979

[30] Foreign Application Priority Data

Feb. 24, 1978 [DE] Fed. Rep. of Germany ..... 2807888

[51] Int. Cl.[2] ..... F02M 7/06

[52] U.S. Cl. ..... 261/39 D; 123/179 G; 123/180 T; 261/69 A; 261/121 B; 261/51

[58] Field of Search ..... 261/39 D, 34 A, 69 A, 261/121 B, 51; 123/179 G, 180 T

[56] References Cited

U.S. PATENT DOCUMENTS

| | | | |
|---|---|---|---|
| 1,904,936 | 4/1933 | Stokes | 261/39 D |
| 3,278,171 | 10/1966 | Carlson | 261/39 D |
| 3,346,245 | 10/1967 | Mennesson | 261/39 D |
| 3,437,081 | 4/1969 | Mennesson | 261/34 A |
| 3,689,036 | 9/1972 | Kikuchi et al. | 261/34 A |
| 3,929,942 | 12/1975 | Harrison et al. | 261/39 D |
| 3,957,026 | 5/1976 | Winkley et al. | 261/39 D |

FOREIGN PATENT DOCUMENTS

| | | | |
|---|---|---|---|
| 719211 | 3/1942 | Fed. Rep. of Germany | 261/69 A |
| S 38751 | 6/1956 | Fed. Rep. of Germany | 261/39 D |
| 1476155 | 4/1969 | Fed. Rep. of Germany . | |
| 2202688 | 2/1975 | Fed. Rep. of Germany | 261/39 D |
| 2803392 | 8/1978 | Fed. Rep. of Germany | 261/39 D |

*Primary Examiner*—Tim R. Miles

*Attorney, Agent, or Firm*—Haseltine, Lake & Waters

[57] ABSTRACT

A carburetor for combustion engines, having upstream of an arbitrarily operated throttle valve, an additional throttling element which is controlled automatically by a membrane unit operated by underpressure of vacuum in accordance with air flow. The additional throttling element controls a fuel jet by means of a needle. The discharge location of the fuel jet is at a point where essentially the same underpressure prevails as in the mixing chamber formed between throttle valve and throttling element. In an enrichment system for the heating phase the fuel jet is controlled by a needle whose variable position is determined by the position of a temperature-sensitive element via a lever, and the fuel quantity for acceleration is varied by means of a second membrane unit. The discharge location of this enrichment system is downstream of the throttling element. The second membrane unit may be actuated by underpressure and may have a pressure chamber closed by a movable membrane loaded by a spring. The pressure chamber has an outflow jet and the membrane operates a valve by means of a plunger.

3 Claims, 3 Drawing Figures

CARBURETOR FOR COMBUSTION ENGINES

BACKGROUND OF THE INVENTION

The present invention relates to a carburetor for combustion engines which upstream of an arbitrarily actuated throttle valve has another throttling element that is automatically controlled by a membrane unit operated by underpressure depending on the airflow. The additional throttling element controls a fuel jet by means of a needle. The discharge end of this jet is located at a point where the same underpressure prevails as in the mixing chamber formed between throttle valve and throttling element, with an enrichment system for the heating phase.

As is well known, after the starting of a cold combustion engine, continued operation requires that the mixture fed to the cold engine be enriched and the amount of mixture be increased above the amount required for the hot engine.

From German Laid-Open Document No. 14 76 155 there is known an equal-pressure carburetor where the control pressure side of the membrane (or diaphragm) unit is vented via a thermostatic needle jet during the heating phase. This results in an additional fuel quantity since the throttling element assumes a smaller opening position not corresponding to the actual air mass flow, causing the needle controlling the fuel jet to assume a different position. However, this known device does not increase the amount of mixture which is possible only with an enrichment system carrying additional fuel. Furthermore, the acceleration enrichment during the heating phase cannot be adapted to the operating condition of the engine. From the German Laid-Open Document No. 22 02 688 there is known a carburetor with an additional enrichment system for the heating phase, but this is not a system adapted to the non-stationary engine operation. The acceleration pumps usually attached to carburetors have their volume laid out for the hot engine, possibly have stepped delivery or extend the injection time, but do not permit continuous adaptation of quantity.

Accordingly, it is an object of the present invention to provide a carburetor of the previously mentioned type whose enrichment system is adapted to non-stationary engine operation, for example, which is equipped with an acceleration unit suitable for the delivery of large volumes and having compact design.

Another object of the present invention is to provide an arrangement of the foregoing character which is substantially simple in construction and may be economincally fabricated.

A further object of the present invention is to provide a carburetor, as described, which may be readily maintained in service and which has substantially long operating life.

The objects of the present invention are achieved by an enrichment system having a fuel jet controlled by a needle whose variable position is determined by the position of a temperature-sensitive element via a lever. The fuel quantity for acceleration is varied by means of a membrane unit and the system's discharge is located downstream of the throttling element. In one embodiment, the membrane unit is actuated by underpressure.

In both embodiments, the membrane unit has a pressure chamber closed by a movable membrane which is loaded by a spring. This pressure chamber has an outflow jet and the membrane operates a valve by means of a plunger.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
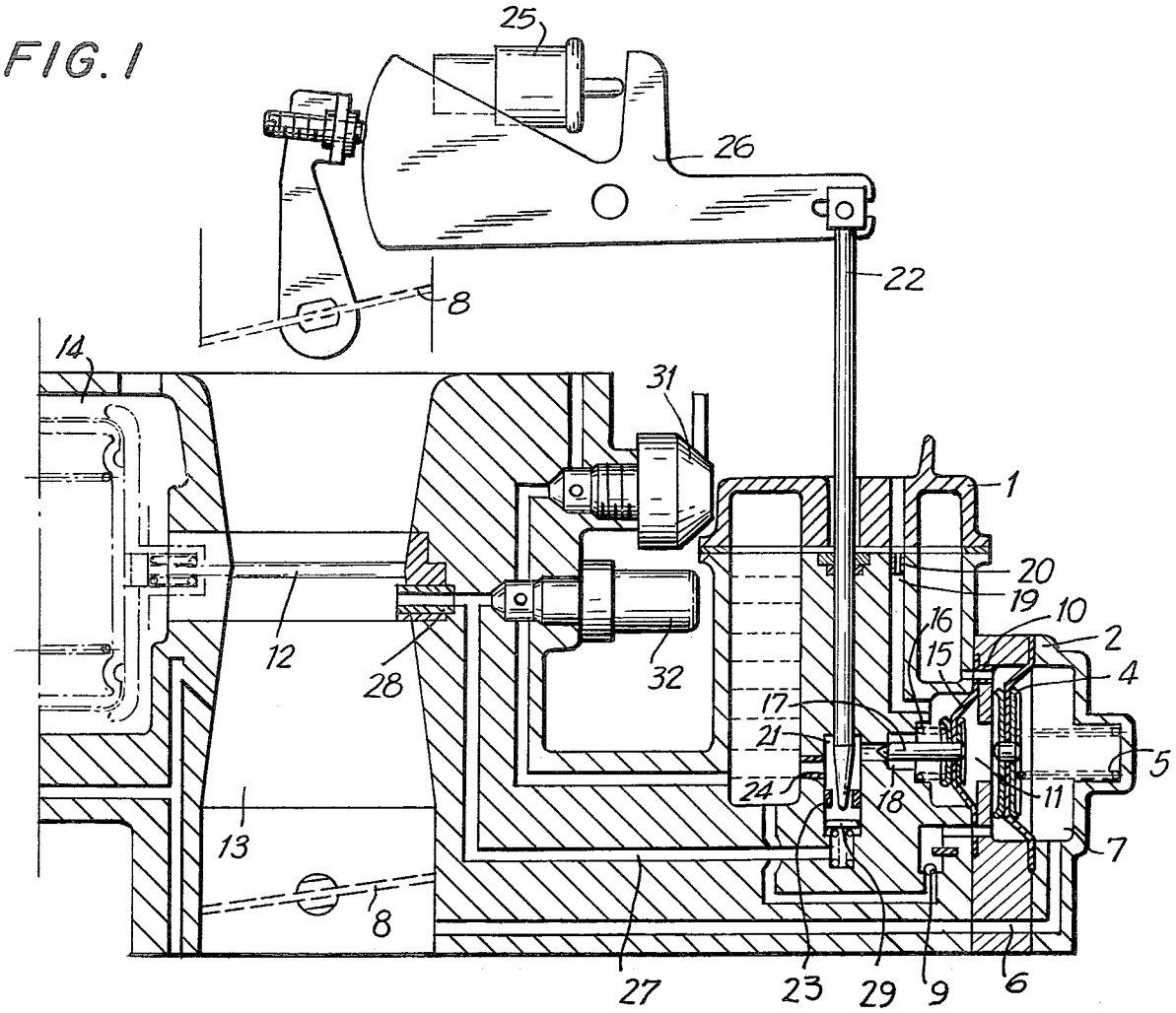
FIG. 1 shows a sectional view taken through the carburetor with the additional enrichment system.
Figure 2:
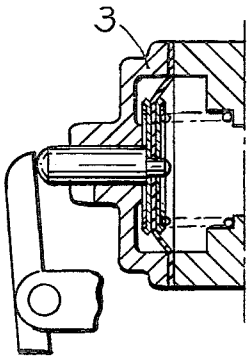
FIG. 2 shows an acceleration unit with mechanical drive.

Referring to the drawings, a pneumatically driven unit 2 is attached to the float chamber 1. A mechanically driven unit 3 may also be used. At high intake pipe underpressure or vacuum, the pneumatic unit 2 has made the intake stroke where membrane 4 was moved against the action of a spring 5. The underpressure reaches the control pressure chamber 7 via a line 6. The pressure is reduced downstream of throttle valve 8. During acceleration, the throttle valve 8 opens and the underpressure (vacuum) in the intake pipe breaks down; the power stroke of unit 2 results through the force of spring 5. The fuel is delivered to unit 2 from the float chamber 1 via a suction valve 9. On the unit pressure side is an outflow nozzle (jet) 10 which below surface level is connected to the float chamber 1. The duration of the power stroke of unit 2 can be determined by calibrating the nozzle 10. During the power stroke an overpressure (above atmospheric) develops due to the throttling effect in the pressure chamber 11; this overpressure drops after the stroke is finished. The delivery quantity is again supplied to the float chamber 1. A second possibility would be the use of this fuel quantity as unregulated acceleration quantity and the addition via an injection pipe (not shown) in the mixing chamber 13 formed between throttling element 12 and throttle valve 8. The throttling element 12 is actuated by a membrane unit 14 according to the airflow. Another membrane 15 is actuated against the force of a spring 16 by a pressure rise in pressure chamber 11. A plunger 17 attached to this spring operates a valve 18 and thus closes an air channel 19 which is connected to atmosphere via a throttle 20. The normally added air quantity enters an annular space 21 located upstream of a fuel jet 23 whose free cross section is controlled by a needle 22. The air quantity is mixed in annular space 21 with the fuel quantity which is metered from the float chamber 1 via a preliminary jet 24. The air quantity forms an emulsion which is metered at the fuel nozzle 23 depending on the position of an expansion material element 25, arranged in the cooling cycle or heated electrically, via a lever 26 which also serves as variable throttle valve stop. This emulsion is delivered downstream of the metering location 22, 23 via a channel 27 to the narrowest cross section of air funnel 13. The discharge location 28 is downstream of the throttling element 12 actuated by a membrane unit 14 (the needle controlling the principal fuel quantity through another nozzle is not shown). During acceleration the air delivery via channel 19 is shut off and more fuel reaches the discharge location 28 via channel 27. Hence the additional fuel quantity for acceleration is also controlled by the temperature-dependent control at metering location 22, 23 and varied according to the engine's state of operation.

When the heating phase is concluded, the enrichment system is shut off because the needle 22 moved by the expansion material element 25 closes a disk valve 29 downstream of the metering location. Thus the acceleration unit has ceased to function.

Figure 3:
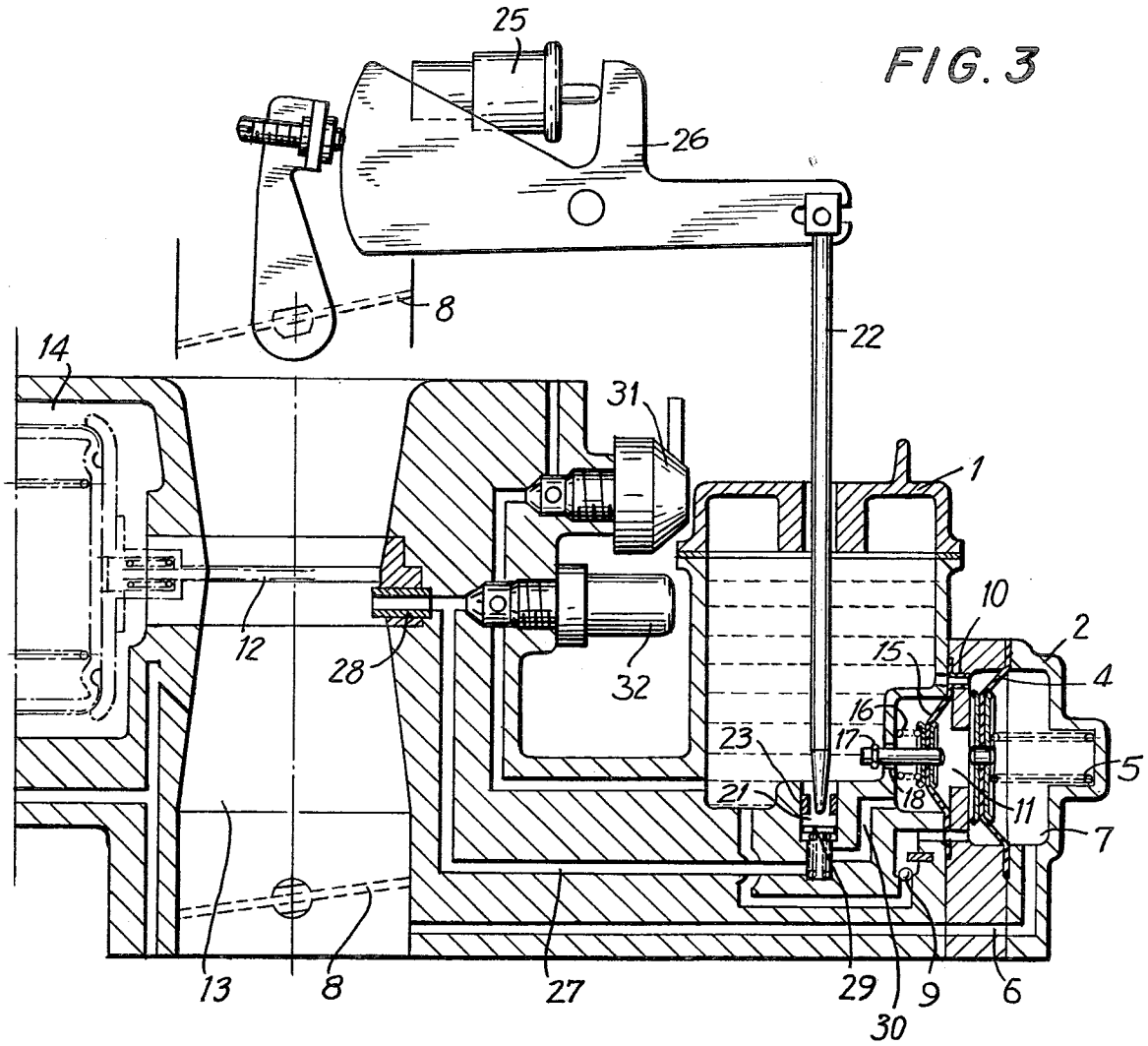
FIG. 3 shows another embodiment of a valve of the acceleration unit.

FIG. 3 shows an embodiment where after the heating phase only the stationary enrichment system is shut off while the valve 18 continues in non-stationary operation to add an acceleration fuel quantity to channel 27, bypassing the metering location 22, 23 via a channel 30 downstream of the disk valve 29.

The additional device is further connected to a device which, for a short time, directly after starting, delivers an emulsion during the time of circulation via the discharge location 28 of mixing chamber 13. An underpressure-actuated air valve 31 and a fast, electrically heated expansion material element 32 shuts off this emulsion.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention, and therefore, such adaptations should and are intended to be comprehended within the meaning and range of equivalents of the following claims.

What is claimed is:

1. A carburetor for combustion engines, comprising: an arbitrarily operated throttle valve located upstream and having air funnel means and a throttling element; enrichment means communicating with said throttling element and located downstream thereof for warm-up; said enrichment means having a fuel nozzle controlled by a needle; lever means and temperature sensing means, said needle having a varying position dependent on the position of said temperature sensing means through said lever means; fuel quantity being varied during acceleration by said throttling element for a predetermined time interval; pressure chamber means having fuel entrance means and fuel discharge means in form of a nozzle to a float chamber; two membranes bordering said pressure chamber; spring means for spring loading each of said membranes; one of said membranes having a plunger which opens and closes a bore communicating with said enrichment means upstream of said fuel nozzle; the other one of said membranes being actuatable dependent on the position of the throttle valve.

2. A carburetor according to claim 1 wherein said other membrane is actuated by suction type vacuum pressure.

3. A carburetor as defined in claim 1 including linkage means connected to said throttle element for mechanically actuating said other membrane.

* * * * *